US006305781B1

(12) United States Patent
Hull

(10) Patent No.: US 6,305,781 B1
(45) Date of Patent: Oct. 23, 2001

(54) METHOD AND APPARATUS FOR IMPROVED BI-DIRECTIONAL ERROR FOR MULTICOLOR PRINTERS

(75) Inventor: Virgil Joseph Hull, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/334,934

(22) Filed: Jun. 17, 1999

(51) Int. Cl.[7] ..... B41J 2/15
(52) U.S. Cl. ..... 347/40; 347/12
(58) Field of Search ..... 347/40, 43, 41, 347/10, 14, 20, 54, 57, 9, 12

(56) References Cited

U.S. PATENT DOCUMENTS 4,386,358 * 5/1983 Fischbeck ..... 347/55
4,523,364 * 6/1985 Bain et al. ..... 347/39
4,528,576 * 7/1985 Koumura et al. ..... 347/15
5,570,118 * 10/1996 Rezanka et al. ..... 347/43
5,675,365 10/1997 Becerra et al. ..... 347/9
5,949,451 * 9/1999 Takagi ..... 347/40
5,956,055 * 9/1999 Gibson et la. ..... 347/40

* cited by examiner

*Primary Examiner*—N. Le
*Assistant Examiner*—Lamson D. Nguyen
(74) *Attorney, Agent, or Firm*—Oliff & Berridge PLC.

(57) ABSTRACT

An apparatus and method for forming an image with fluids having different firing velocities from a bi-directional print head results in a reduction in bi-directional misalignment error. The bi-directional misalignment error is reduced by delaying the firing of a drop of the higher velocity fluid on the return swath of the print head.

17 Claims, 5 Drawing Sheets

METHOD AND APPARATUS FOR IMPROVED BI-DIRECTIONAL ERROR FOR MULTICOLOR PRINTERS

BACKGROUND OF THE INVENTION

1. Field of Invention

The invention relates to alignment errors in bi-directional printing.

2. Description of Related Art

Image recording devices such as, for example, inkjet printers, fire drops of recording fluid from rows of nozzles of a print head. The nozzles are usually fired sequentially in groups beginning at one end of the head and continuing to the other end of the head. While the nozzles are being fired, the head moves at a rate designed to advance it by a resolution distance before the next firing sequence begins. As an example, for a 300 dot per inch (dpi) resolution with a firing frequency of 5.5 KHz, the print head moves 84.7 μm across the page in 182 μsec. If, for example, the velocity of the drop of recording fluid is 7 m/sec and the distance from the print head to the paper is 1.1 mm, the drop will require 157 μsec to reach the paper. During this time, the drop will drift sideways by 73 μm due to the motion of the print head. If the nozzles are not fired simultaneously, the row of nozzles is usually tilted so that drops fired from all nozzles land in a substantially vertical column.

It is often desirable to operate the print head bi-directionally to enhance productivity. The sideways drift of the print head between the location of the drop of recording fluid being fired and the location of the dot on the paper results in a bi-directional misalignment of two drops, one in each printing direction, fired at the same print head location. In the example given above, where the sideways drift is 73 μm in the direction the printhead is moving, this misalignment would be 146 μm for bi-directional printing. To compensate for this misalignment, the drops fired while the print head is moving in the reverse direction should be fired before the print head reaches the location at which the drop in the forward direction was fired. This firing lead time should be twice as long as the time required for a drop to reach the paper. In the above example, this would be 314 μsec (2×157 μsec).

The appropriate amount of lead time is determined by the printer, typically by means of a test pattern where the user is allowed to choose from the best aligned of a series of vertical lines. This procedure works relatively well where all of the nozzles fire drops at the same velocity.

SUMMARY OF THE INVENTION

The drops will tend to fire at the same velocity for a monochrome print head. In contrast, a multicolor print head can have drops that fire at significantly different velocities.

In a multicolor print head, different colored fluids are often fired at different velocities due to, for example, different colors having different drop volumes for optimum print quality. Because two drops of fluid fired from the print head at different velocities require a different amount of time between firing and hitting the paper, the drift of the print head between firing the drop and the drop hitting the paper is different for each different velocity. In a print head moving at 84.7 μm in 182 μsec, as described above, fluid fired at 7 m/sec results in a 73 μm drift of the print head. For the same print head, fluid fired at 9 m/sec results in a 57 μm drift. In this example, a drop fired at 7 m/sec and a drop fired at 9 m/sec would be separated by 16 μm on the paper. This would result in a bi-directional misalignment of 32 μm (2×16 μm). If the vertical alignment test discussed above fires jets of only one color or type of fluid, having a first velocity, the bi-directional misalignment for jets firing a second color or type of fluid having a different velocity will not be eliminated or reducted.

In order to eliminate or reduce this bi-directional misalignment of the drops having different velocities, the systems and methods according to this invention time delay firing drops of fluid that are fired at a higher velocity in order to compensate for the different duration of time required for different velocity drops to travel between the print head and the paper. Similarly, the firing of drops of fluid fired at a lower velocity could be advanced.

For ease of discussion, as an example of one type of print head, the systems and methods according to this invention will be described using a print head having one row of nozzles. The fluid, for example ink, is fired from the nozzles sequentially beginning at one end of the row and ending at the other end of the row. Such a sequential firing is called a stroke. In each stroke, only certain ones of the nozzles are fired as required by the image being printed. In the case of a color printer, one stroke could contain drops of a first colored ink and drops of a second colored ink, each colored ink being fired at a different velocity. In one exemplary embodiment of the systems and methods according to this invention, the bi-directional alignment is improved by relatively delaying a drop of a higher velocity ink from one stroke to a subsequent stroke in order to partially compensate for the decreased time required for the higher velocity drop of fluid to hit the paper.

Depending on the different velocities of the fluids being fired, the relative firing delay of the higher velocity fluid can be implemented in either or both printing directions.

These and other features and advantages of the invention are described in or are apparent from the following detailed description of the exemplary embodiments.

BRIEF DESCRIPTION OF THE DRAWINGS

Various exemplary embodiments of the invention will be described in relation to the following drawings in which like reference numerals refer to like elements, and wherein.

DETAILED DESCRIPTION OF EXEMPLARY EMBODIMENTS

One exemplary embodiment of an image recording apparatus according to this invention has a print head movable in a first direction and a second direction opposite to the first direction. The print head is capable of firing drops of a first recording fluid at a first velocity and drops of a second recording fluid at a second velocity that may be different from the first velocity. In an image recording apparatus incorporating the systems and methods of this invention, a controller controls the firing and firing timing of the drops of the recording fluids such that a bi-directional alignment error that would otherwise be present using conventional printing techniques is reduced or eliminated.

Figure 1:
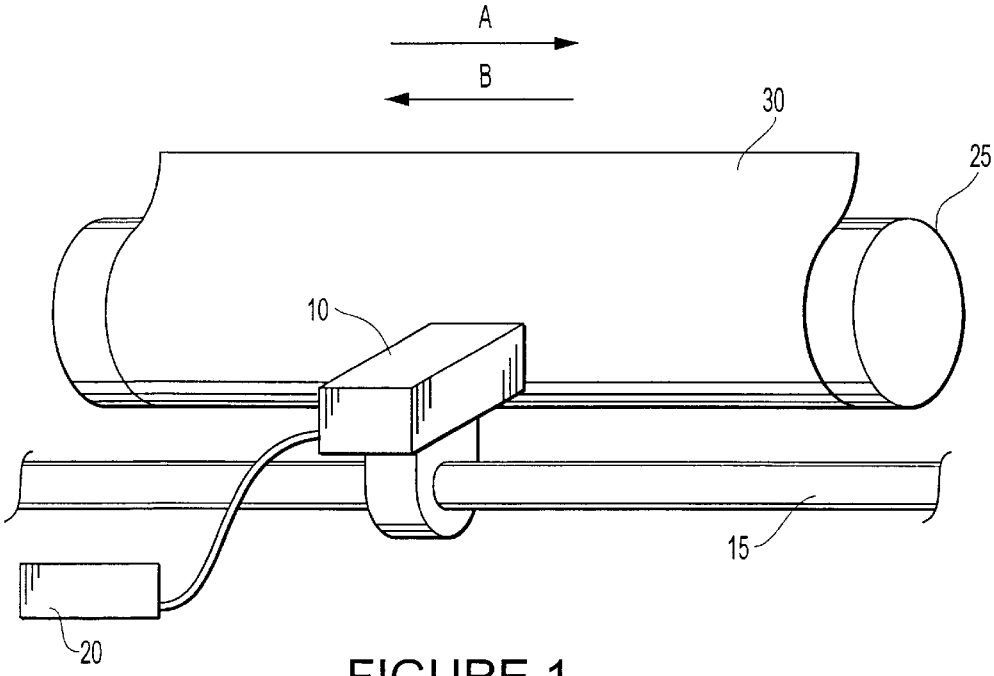
FIG. 1 is a perspective view of an exemplary image recording apparatus in which the systems and methods of the invention can be used.

FIG. 1 shows a portion of an image recording apparatus that incorporates the systems and methods of the invention. As shown in FIG. 1, a print head 10 slides in a first direction A and a second direction B opposite the first direction A along a guide rod 15. As the print head 10 moves back and forth, an image is recorded on a recording medium 30 which is supported by a platen 25. A controller 20 provides print information to the print head 10 to control the image printed by the print head 10.

Figure 2:
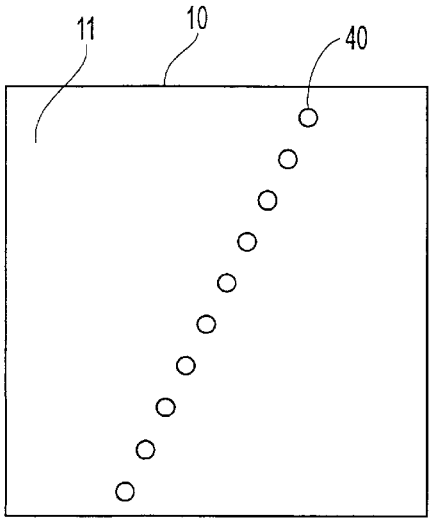
FIG. 2 is one exemplary embodiment of a face of a print head of the invention.
Figure 3:
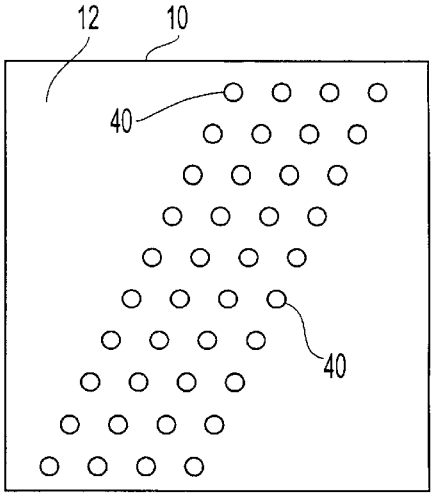
FIG. 3 is another exemplary embodiment of a face of a print head of the invention.

FIG. 2 shows the face 11 of one exemplary embodiment of the print head 10. This exemplary embodiment of the print head 10 has one row of nozzles 40 on the face 11. FIG. 3 shows the face 12 of a second exemplary embodiment of the print head 10. This exemplary embodiment of the print head 10 has four rows of nozzles 40 on the face 12. FIGS. 2 and 3 are simply two examples of many configurations of the print heads usable with the systems and methods of the invention. The print head 10 could have any appropriate number of rows of nozzles or other configurations of nozzles controllable by the controller. Further, multiple print heads can be used.

FIGS. 4–7 show dots of recording fluid, for example ink, on a recording medium. The gridlines 50 in FIGS. 4–7 represent resolution steps of the recorded image, one resolution step equaling the diameter of a dot of ink. White dots represent dots formed by drops of fluid fired from the print head at the recording medium at a first velocity. Black dots represent dots formed by drops of recording fluid fired from the print head at a second velocity different from the first velocity.

Figure 4:
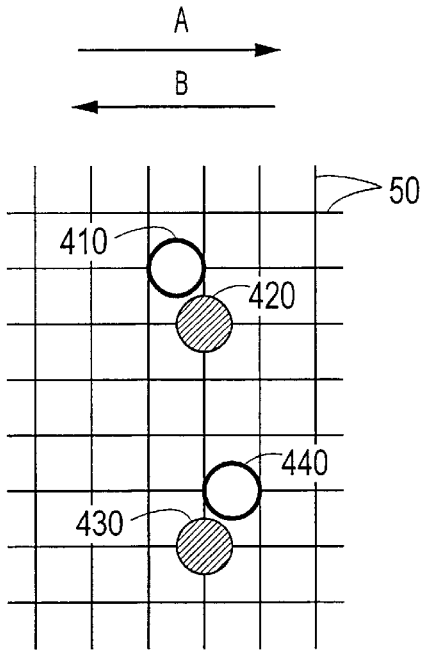
FIG. 4 shows an example of uncompensated bi-directional error in image formation.

FIG. 4 shows an example of an image formed by a bi-directional print head without implementing the systems and methods according to the invention. In FIG. 4, a first drop of a first recording fluid is fired at the recording medium at a first velocity to form a first dot 410. A first drop of a second recording fluid is fired at the recording medium at a second velocity, that is slower than the first velocity, to form a second dot 420. The first and second dots 410 and 420 are formed as the print head moves in the first direction A. Due to the lower velocity of the second recording fluid as compared to the first recording fluid, the second dot 420 is formed one-half resolution step after the first dot 410. This is caused by the longer period of time needed for the first drop of the second recording fluid to reach the recording medium compared to the first drop of the first recording fluid, and the movement of the print head in the direction A. On the return stroke in direction B, a second drop of the second recording fluid is fired at the recording medium to form a third dot 430. Also, the return stroke of the print head, in the direction B, a second drop of the first recording fluid is fired at the recording medium to form a fourth dot 440. In the same manner as with the first dot 410 and the second dot 420, the third dot 430 is formed one-half resolution step after the fourth dot 440. In FIG. 4, the second dot 420 and the third dot 430 have been aligned using an alignment test pattern as discussed above. As a result, the first dot 410 and the fourth dot 440 are misaligned by one full resolution step. This misalignment results from the first and second drops of the first recording fluid hitting the recording medium before the first and second drops of the second recording fluid, due to the higher velocity of the first recording fluid. The first and second dots 410 and 420 are fired in one stroke of the print head and the third and fourth dots 430 and 440 are fired in another stroke of the print head.

Figure 5:
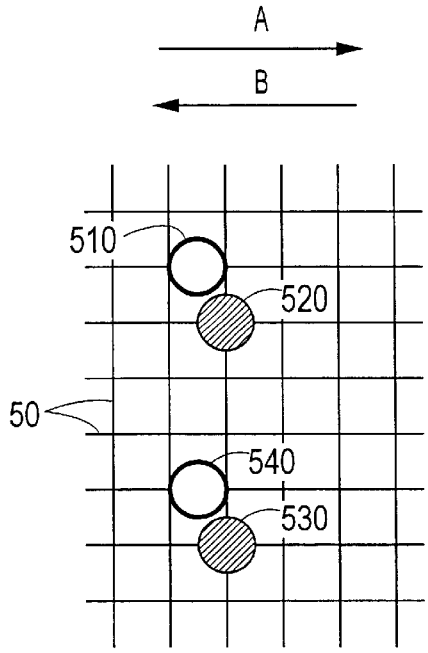
FIG. 5 shows the print data of FIG. 4 after compensation in accordance with a first exemplary embodiment of the systems and methods of the invention.

FIG. 5 shows the same print data as FIG. 4, except that the bi-directional error present in FIG. 4 has been eliminated by revising the firing timing of some or all of the first-fourth dots 410–440 in accordance with the systems and methods of the invention. The composition of the dots 510–540 shown in FIG. 5 and their firing order is identical to the dots 410–440 shown in FIG. 4, except that the firing of the second drop of the first recording fluid is relatively delayed so that fourth dot 540 is formed one resolution step later than fourth dot 440 shown in FIG. 4. By relatively delaying the firing of the second drop of the first recording fluid in this manner, the fourth dot 540 aligns with the first dot 510, resulting in an image having an improved bi-directional alignment formed on the recording medium. The relative delay between firing of drops of fluid having different velocities can be achieved by delaying the firing of the drops of higher velocity fluid, advancing the firing of the drops of lower velocity fluid, or a combination of both.

One way of relatively delaying the firing of the second drop of the first recording fluid is to fire the second drop of the first recording fluid in a different (later) stroke of the print head than the second drop of the second recording fluid. Another way of relatively delaying the firing of the second drop of the first recording fluid is to fire the second drop of the second recording fluid in an earlier stroke of the print head than the second drop of the first recording fluid. In a print head capable of controlling the firing sequence of the jets in the print head, the relative delay can be created by altering the firing sequence so that a particular jet fires before or after it would otherwise be fired.

Figure 6:
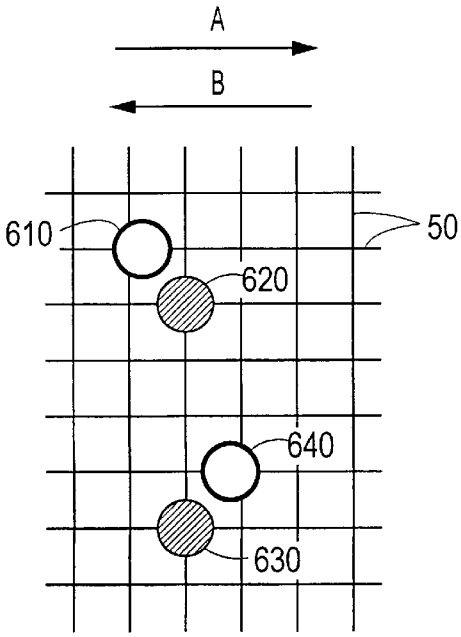
FIG. 6 shows a second example of uncompensated bi-directional error in image formation; FIG.

FIG. 6 shows another example of an image having bi-directional misalignment when the systems and methods according to the invention are not used. The first, second, third and fourth dots 610–640 have the same composition and firing order as the corresponding dots 410–440 shown in FIG. 4. However, FIG. 6 shows the first dot 610 and the fourth dot 640 formed by drops of the first recording fluid being formed on the recording medium three-quarters of a resolution step before the second dot 620 and the third dot 630 formed by drops of the second recording fluid. In FIG. 4, the dots were offset by only ½ a resolution step. This additional offset could be caused by a larger difference between the velocities of the first recording fluid and the second recording fluid.

Figure 7:
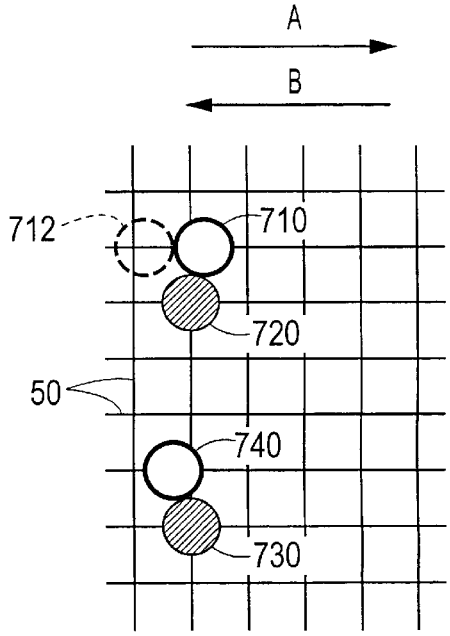
FIG. 7 shows the print data of FIG. 6 after compensation in accordance with a second exemplary embodiment of the systems and methods of the invention.

FIG. 7. shows first-fourth dots 710–740 that correspond to the first-fourth dots 610–640 shown in FIG. 6 after bi-directional misalignment compensation according to the systems and methods of the invention is used. The compensated position of the fourth dot 740 is a result of relatively delaying the firing of the second drop of the first recording fluid in the same manner as described in relation to the fourth dot 540 shown in FIG. 5. Relatively delaying only the firing of the second drop of the first recording fluid would result in a one-half resolution step bi-directional error between the fourth dot 740 and the first dot 712. While this compensation results in an image having an improved bi-directional misalignment over the bi-directional misalignment of the image shown in FIG. 6, the bi-directional alignment of image shown in FIG. 6 can be further improved by also relatively delaying the firing of the first drop of the first recording fluid, so that the location of the first dot 710 is offset by a resolution step relative to the location of the first dot 712. This relative delay causes the first dot to be formed one resolution step later than it would be formed without the bi-directional misalignment compensation according to the systems and methods of the invention. Although the positions of the first dots 710 and 712 are both offset by one-half resolution step from the position of the fourth dot 740, the positions of the first dot 710 and fourth dot 740 are centered about an alignment line of the second and third dots 720, 730. This results in an image having a further improved bi-directional alignment because the four dots 710–740 are more properly aligned than if the first dot 712 is formed rather than the first dot 710.

The relative delay between firing of drops of fluid having different velocities can be achieved by delaying the firing of the drops of higher velocity fluid, advancing the firing of the drops of lower velocity fluid, or a combination of both.

Figure 8:
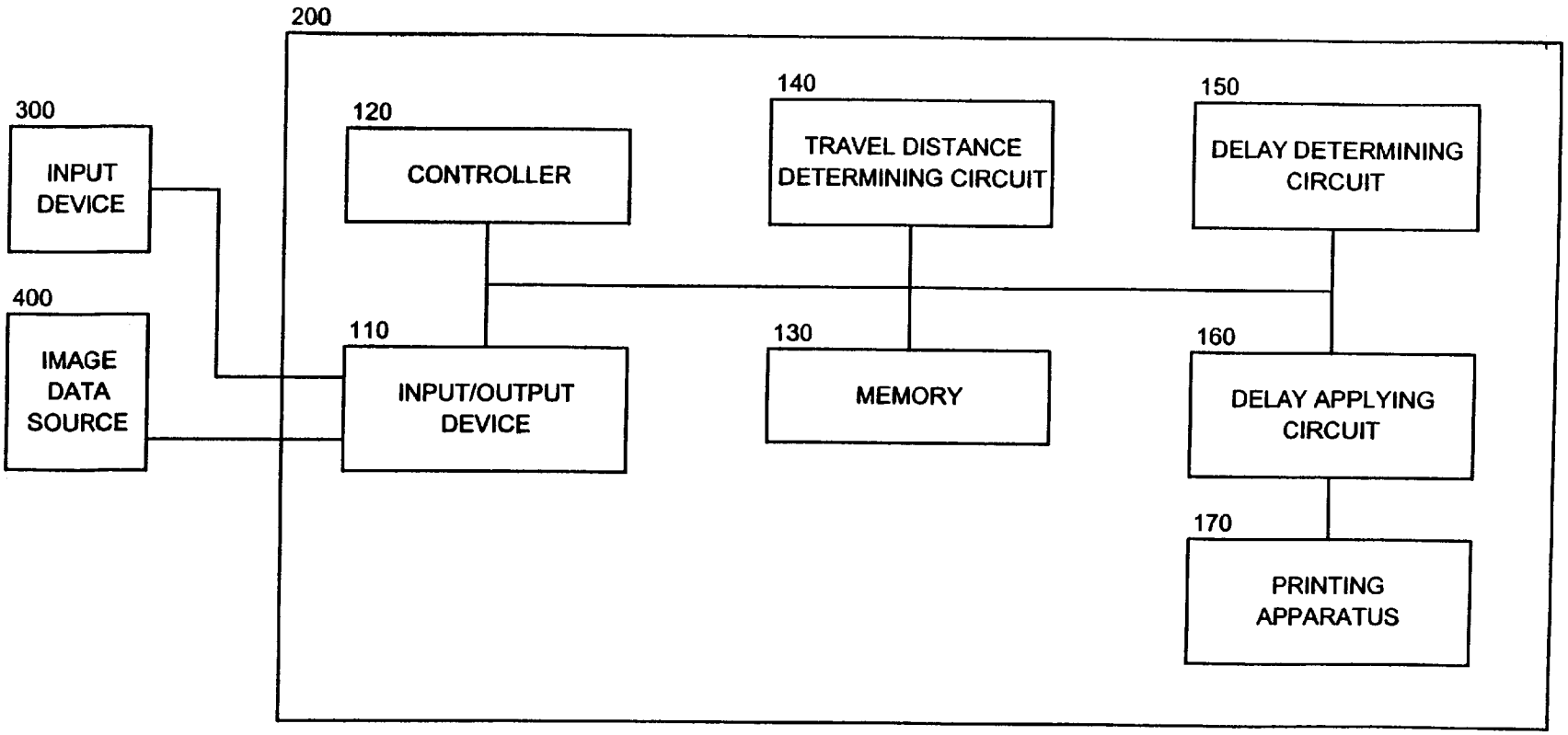
FIG. 8 is a functional block diagram of an exemplary embodiment of the invention.

FIG. 8 is a functional block diagram of one exemplary embodiment of a printing device 200 incorporating the systems and methods of the invention. The printing device 200 has an input/output device 110 that connects the printing device 200 to an input device 300, such as, for example, a keyboard or interactive display, and an image data source 400 such as, for example, a computer. In general, the image data source 400 can be any one of a number of different sources, such as a scanner, a digital copier, a facsimile device that is suitable for generating electronic image data, or a device suitable for storing and/or transmitting electronic image data, such as a client or server of a network, or the Internet, and especially the World Wide Web. For example, the image data source 400 may be a scanner, or a data carrier such as a magnetic storage disk, CD-ROM or the like, or a host computer, that contains scanned image data. Thus, the image data source 400 can be any known or later developed source that is capable of providing image data to the printing device 200 of this invention.

When the image data source 400 is a personal computer, the data line connecting the image data source 400 to the printing device 200 can be a direct link between the personal computer and the printing device 200. The data line can also be a local area network, a wide area network, the Internet, an intranet, or any other distributed processing and storage network. Moreover, the data line can also be a wireless link to the image data source 400. Accordingly, it should be appreciated that the image data source 400 can be connected using any known or later developed system that is capable of transmitting data from the image data source 400 to the printing device 200.

The input/output device 110, a memory 130, a travel distance determining circuit 140, a delay determining circuit 150, and a delay applying circuit 160 communicate over a data/control bus with a controller 120. The travel distance determining circuit 140 determines a distance traveled by the print head between firing a drop of each different type of recording fluid and the drop of that recording fluid hitting the recording medium, based on the speed of the print head, the distance of the print head from the recording medium and the velocity of that recording fluid. The delay determining circuit 150 determines the relative delay required when firing a second drop of that recording fluid to result in the reduced separation between first and second drops of that recording fluid. The delay applying circuit 160 applies the delay determined by the delay determining circuit 150 to a printing apparatus 170. The printing apparatus 170 can be, for example, the print head.

It should be understood that each of the circuits shown in FIG. 8 can be implemented as portions of a suitably programmed general purpose computer. Alternatively, each of the circuits shown in FIG. 8 can be implemented as physically distinct hardware circuits within an ASIC, or using a FPGA, a PDL, a PLA or a PAL, or using discrete logic elements or discrete circuit elements. The particular form each of the circuits shown in FIG. 8 will take is a design choice and will be obvious and predicable to those skilled in the art.

Figure 9:
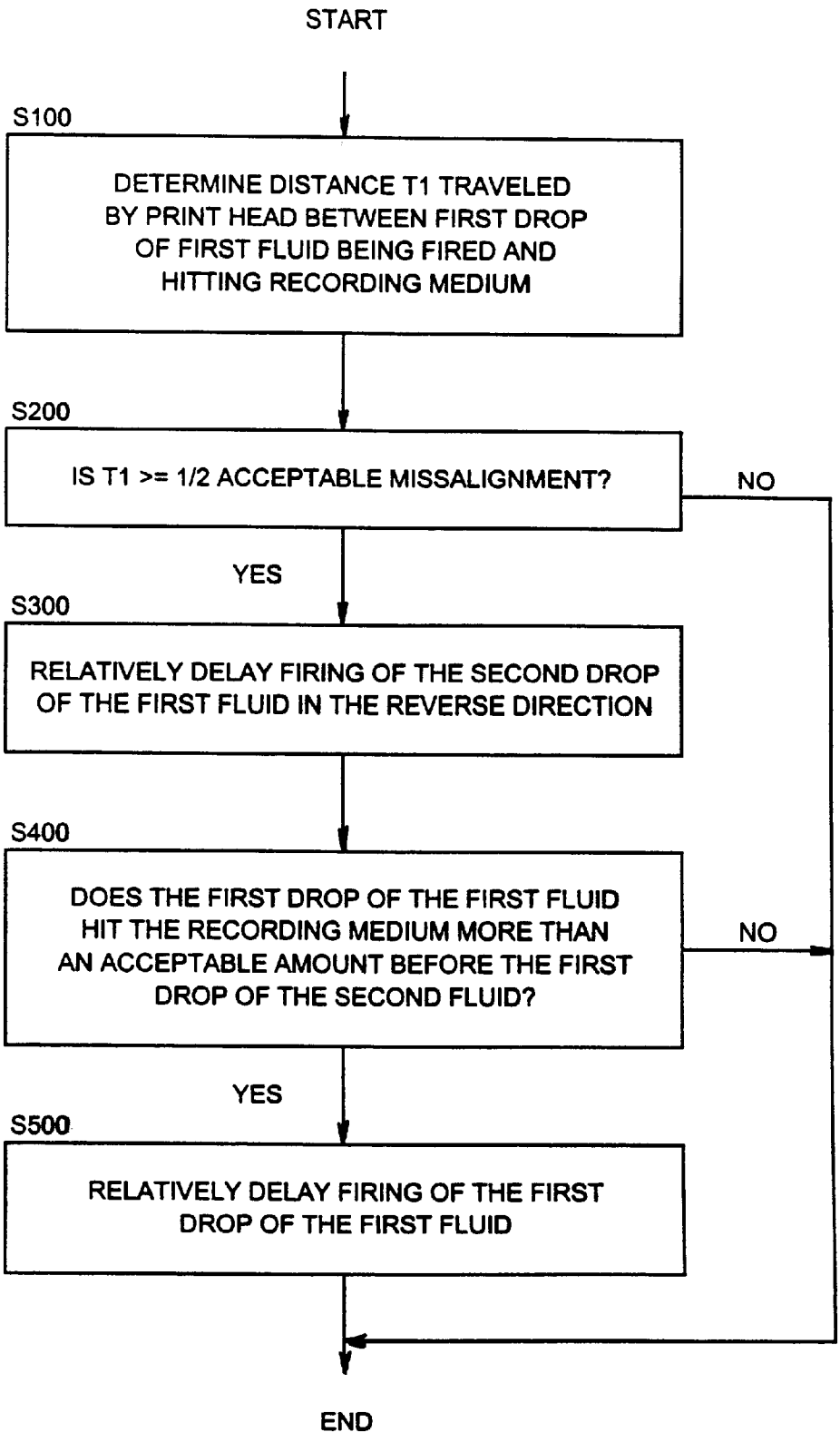
FIG. 9 is a flow chart showing a process of a controller of the invention.

FIG. 9 is a flow chart showing one example of a process of the invention. In step S100, a distance Ti traveled by the print head between the first drop of the first fluid being fired and the first drop of the first fluid hitting the recording medium is determined. If it is determined in step S200 that distance T1 is greater than or equal to one-half an acceptable misalignment, processing proceeds to step S300. If not, processing ends. In step S300, the firing of the second drop of the first fluid in the reverse direction is relatively delayed to create a smaller misalignment. If it is determined that the first drop of the first fluid would otherwise hit the recording medium more than an acceptable amount before the first drop of the second fluid, processing proceeds to step S500. If not, processing ends. In step S500, the firing of the first drop of the first fluid is relatively delayed to create a smaller misalignment between the first drop of the first fluid and the first drop of the second fluid.

Figure 10:
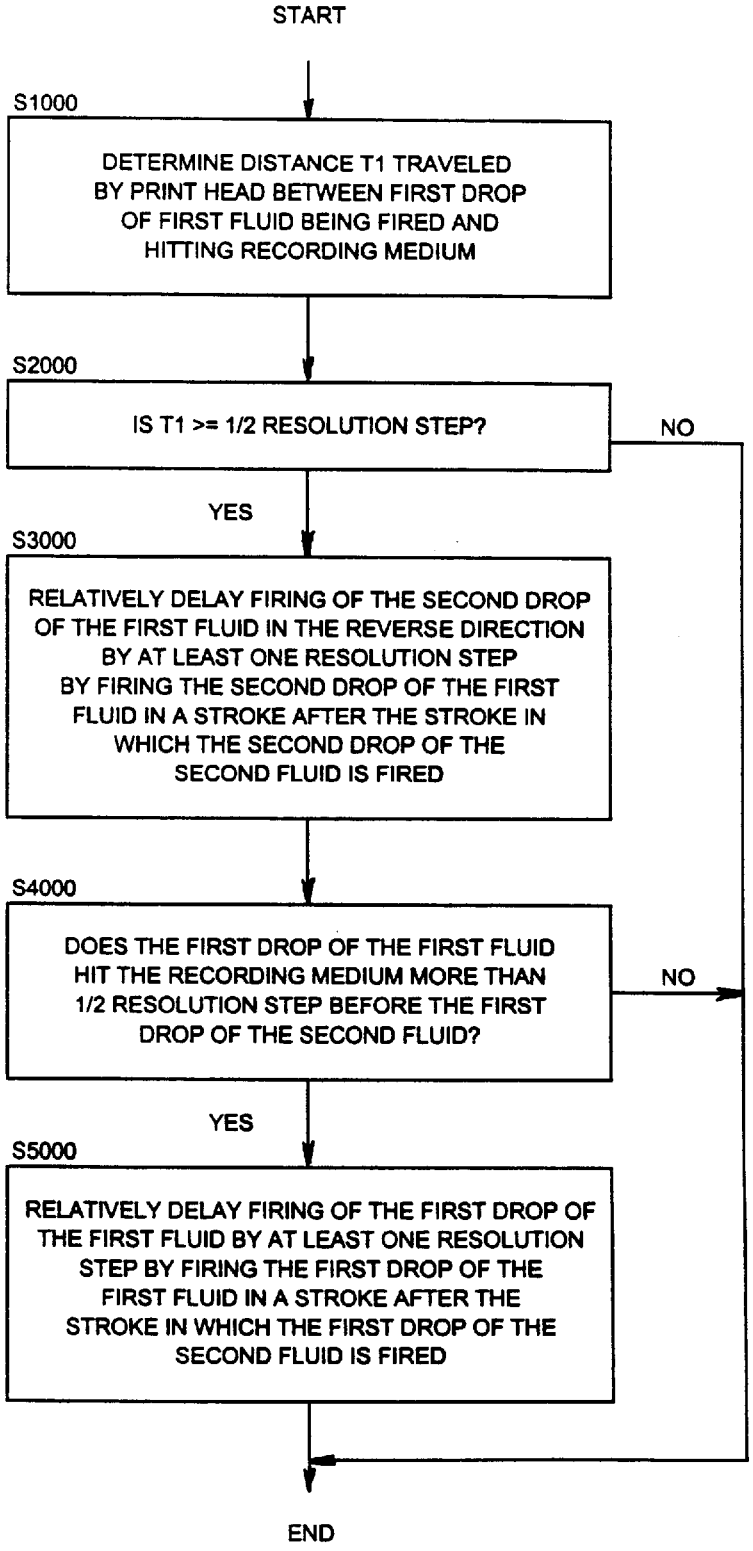
FIG. 10 is a flow chart showing a process of another controller of the invention.

FIG. 10 is a flow chart showing another example of a process of the invention. In step S1000, a distance T1 traveled by the print head between the first drop of the first fluid being fired and the first drop of the first fluid hitting the recording medium is determined. If it is determined in step S2000 that distance T1 is greater than or equal to one-half resolution step, processing proceeds to step S3000. If not, processing ends. In step S3000, the firing of the second drop of the first fluid in the reverse direction is relatively delayed by at least one resolution step by firing the second drop of the first fluid in a stroke after the stroke in which the second drop of the second fluid is fired. If it is determined that the first drop of the first fluid would otherwise hit the recording medium more than one-half resolution step before the first drop of the second fluid, processing proceeds to step S5000. If not, processing ends. In step S5000, the firing of the first drop of the first fluid is relatively delayed by at least one resolution step by firing the first drop of the first fluid in a stroke after the stroke in which the first drop of the second fluid is fired.

As shown in FIG. 8, the printing device 200 is preferably implemented on a programmed general purpose computer. However, the printing device 200 can also be implemented on a special purpose computer, a programmed microprocessor or microcontroller and peripheral integrated circuit elements, an ASIC or other integrated circuit, a digital signal processor, a hardwired electronic or logic circuit such a discrete element circuit, a programmable logic device such as a PLD, PLA, FPGA or PAL, or the like. In general, any device, capable of implementing a finite state machine that is in turn capable of implementing the flowcharts shown in FIG. 9, can be used to implement the printing device 200.

In an exemplary embodiment, the controller controls the firing of the drops of recording fluids such that a first drop of the first recording fluid is fired at the first velocity while the print head is moving in the first direction to form a first dot on a recording medium, a first drop of the second recording fluid is fired at the second velocity while the print head is moving in the first direction to form a second dot on the recording medium, a second drop of the second recording fluid is fired at the second velocity while the print head is moving in the second direction to form a third dot on the recording medium, a second drop of the first recording fluid is fired at the first velocity while the print head is moving in the second direction to form a fourth dot on the recording medium, and the firing of the second drop of the first recording fluid is relatively delayed such that a distance between the first dot and the fourth dot is less than or equal to one half of a resolution step of the image.

In other exemplary embodiments, the controller relatively delays the firing of the first drop of the first recording fluid such that a distance between the first dot and the second dot is less than or equal to one-half of a resolution step of the image. The firing of the first drop and/or the second drop can be delayed by the controller.

In some exemplary embodiments where the print head has a row of nozzles, the controller can control the firing of the drops of the first and second recording fluids such that the drops of the first and second recording fluids are fired from particular nozzles of the row of nozzles, the particular nozzles being selectively sequentially fired in strokes, where each stroke begins at one end of the row and ends at the other end of the row. In some of these exemplary embodiments, the controller controls the firing of the drops of the recording fluids such that the first drop of the first recording fluid and the first drop of the second recording fluid are fired in a first stroke, the second drop of the second recording fluid is fired in a second stroke and the firing of the second drop of the first recording fluid is relatively delayed. This relative delay can be created by firing the second drop of the first recording fluid in a third stroke after the second stroke. The third stroke may be immediately after the second stroke.

In other exemplary embodiments, the controller controls the firing of the drops of the recording fluids such that the first drop of the second recording fluid is fired and the firing of the first drop of the first recording fluid is relatively delayed. This relative delay can be created by firing the first drop of the second recording fluid in a first stroke and by firing the first drop of the first recording fluid in a second stroke after the first stroke. The controller further controls the firing of the drops of the recording fluids such that the second drop of the second recording fluid is fired and the firing of the second drop of the first recording fluid is relatively delayed. This relative delay can be created by firing the second drop of the second recording fluid in a third stroke and firing the second drop of the first recording fluid in a fourth stroke after the third stroke. In some of these exemplary embodiments, the second stroke may be immediately after the first stroke and/or the fourth stroke may be immediately after the third stroke.

While the systems and methods of the invention have been explained with relation to a print head having a row of jets that are sequentially fired in strokes, the systems and methods of the invention are also applicable to other types of printing systems. For example, printing systems as shown in U.S. Pat. No. 5,675,365, incorporated herein by reference, can benefit from the invention by scheduling the activation of specific ejectors such that bi-directional misalignment is reduced or eliminated.

Further, while the systems and methods of the invention have been explained using two fluids having different velocities, the systems and methods of the invention are also applicable to image forming systems and methods using any number of fluids having different velocities. As an example, systems and methods using 3, 4 or 6 different colors can benefit from the reduction or elimination of bi-directional misalignment resulting from the invention.

In addition, while one skilled in the art of printing will apply the systems and methods of the invention to printing with ink, it is noted that the systems and methods of the invention apply to fluids other than ink.

In the above examples, the first recording fluid and the second recording fluid were fired at different velocities. The difference in the velocities can be caused by, for example, different sized drops of recording fluid or different chemical or physical properties of recording fluid such as density or surface tension. In some exemplary embodiments of the invention, an alignment procedure where the user is allowed to choose from the best aligned of a series of vertical lines can be performed for each recording fluid to determine the best delay pattern for a particular print head.

While the invention has been described in conjunction with the specific embodiments outlined above, it is evident that many alternatives, modifications and variations will be apparent to those skilled in the art. Accordingly, the exemplary embodiments of the invention as set forth above are intended to be illustrative and not limiting. Various changes may be made without departing from the spirit and scope of the invention as described herein.

What is claimed is:

1. A method of forming an image having a resolution on a medium, the method comprising:

moving a print head in a first direction and a second direction opposite the first direction;

firing a first drop of a first fluid at a first velocity while the print head is moving in the first direction to form a first dot on the medium;

firing a first drop of a second fluid at a second velocity different from the first velocity while the print head is moving in the first direction to form a second dot on the medium;

firing a second drop of the second fluid at the second velocity while the print head is moving in the second direction to form a third dot on the medium, the third dot substantially aligned with the second dot in a direction perpendicular to the first direction;

firing a second drop of the first fluid at the first velocity while the print head is moving in the second direction to form a fourth dot on the medium;

wherein the drops of the first and second fluids are fired from particular nozzles of a row of nozzles in the print head, the particular nozzles selectively sequentially fired in strokes, each stroke beginning at one end of the row and ending at the other end of the row; and relatively adjusting the firing between the first and second drops of the first fluid by at least one stroke such that a distance between the first dot and the fourth dot is less than or equal to a predetermined amount.

2. The method of claim 1, wherein the relative adjustment in firing is such that the predetermined amount is one-half of a resolution step of the image.

3. The method of claim 2, wherein the first drop of the first fluid and the first drop of the second fluid are fired in a first stroke, the second drop of the second fluid is fired in a second stroke and the firing of the second drop of the first fluid is delayed by firing the second drop of the first fluid in a third stroke after the second stroke.

4. The method of claim 3, wherein the third stroke is immediately after the second stroke.

5. The method of claim 1, further comprising relatively ajusting the firing between the first drop of the first fluid and the first drop of the second fluid such that a distance between the first dot and the second dot is less than or equal to the predetermined amount.

6. The method of claim 5, wherein the drops of the first and second fluids are fired from particular nozzles of a row of nozzles in the print head, the particular nozzles selectively sequentially fired in strokes, each stroke beginning at one end of the row and ending at the other end of the row, and the relative adjustment in firing is such that the predetermined amount is one-half of a resolution step of the image.

7. The method of claim 6, wherein the first drop of the second fluid is fired in a first stroke, the firing of the first drop of the first fluid is delayed by firing the first drop of the first fluid in a second stroke after the first stroke, the second drop of the second fluid is fired in a third stroke and the firing of the second drop of the first fluid is delayed by firing the second drop of the first fluid in a fourth stroke after the third stroke.

8. The method of claim 7, wherein the second stroke is immediately after the first stroke and the fourth stroke is immediately after the third stroke.

9. An image forming apparatus, comprising:

a print head movable in a first direction and a second direction opposite the first direction, the print head being capable of firing drops of a first fluid at a first velocity and drops of a second fluid at a second velocity different from the first velocity; and a controller that controls the firing of the drops of the first fluid and the drops of the second fluid such that a first drop of the first fluid is fired at the first velocity while the print head is moving in the first direction to form a first dot on a medium, a first drop of the second fluid is fired at the second velocity while the print head is moving in the first direction to form a second dot on the medium, a second drop of the second fluid is fired at the second velocity while the print head is moving in the second direction to form a third dot on the medium, the third dot being substantially aligned with the second dot in a direction perpendicular to the first direction, a second drop of the first fluid is fired at the first velocity while the print head is moving in the second direction to form a fourth dot on the medium, wherein the print head has a row of nozzles and the controller controls the firing of the drops of the first fluid and the drops of the second fluid such that the drops of the first fluid and the drops of the second fluid are fired from particular nozzles of the row of nozzles, the particular nozzles selectively sequentially fired in strokes, each stroke beginning at one end of the row and ending at the other end of the row; and the firing of the first drop of the first fluid and the firing of the second drop of the first fluid are relatively adjusted by at least one stroke such that a distance between the first dot and the fourth dot is less than or equal to a predetermined amount.

10. The image forming apparatus of claim 9, wherein the relative adjustment in firing is such that the predetermined amount is one-half of a resolution step of the image.

11. The image forming apparatus of claim 10, wherein the controller controls the firing of the drops of the first fluid and the drops of the second fluid such that the first drop of the first fluid and the first drop of the second fluid are fired in a first stroke, the second drop of the second fluid is fired in a second stroke and the firing of the second drop of the first fluid is delayed by firing the second drop of the first fluid in a third stroke after the second stroke.

12. The image forming apparatus of claim 11, wherein the third stroke is immediately after the second stroke.

13. The image forming apparatus of claim 9, wherein the controller relatively adjusts the firing between the first and second drops of the first fluid such that a distance between the first dot and the second dot is less than or equal to the predetermined amount.

14. The image forming apparatus of claim 13, wherein the print head has a row of nozzles and the controller controls the firing of the drops of the first fluid and the drops of the second fluid such that the drops of the first fluid and the drops of the second fluid are fired from particular nozzles of the row of nozzles, the particular nozzles selectively sequentially fired in strokes, each stroke beginning at one end of the row and ending at the other end of the row, and the relative adjustment in firing is such that the predetermined amount is one-half of a resolution step of the image.

15. The image forming apparatus of claim 14, wherein the controller controls the firing of the drops of the first fluid and the drops of the second fluid such that the first drop of the second fluid is fired in a first stroke, the firing of the first drop of the first fluid is delayed by firing the first drop of the first fluid in a second stroke after the first stroke, the second drop of the second fluid is fired in a third stroke and the firing of the second drop of the first fluid is delayed by firing the second drop of the first fluid in a fourth stroke after the third stroke.

16. The image forming apparatus of claim 15, wherein the second stroke is immediately after the first stroke and the fourth stroke is immediately after the third stroke.

17. An image forming apparatus, comprising:

means for moving a print head in a first direction defining a stroke and a second direction defining a stroke opposite the first direction;

first firing means for firing a first drop of a first fluid at a first velocity while the print head is moving in the first direction to form a first dot on a medium; and second firing means for firing a first drop of a second fluid at a second velocity different from the first velocity while the print head is moving in the first direction to form a second dot on the medium, wherein:

the second firing means fires a second drop of the second fluid at the second velocity while the print head is moving in the second direction to form a third dot on the medium, the third dot substantially aligned with the second dot in a direction perpendicular to the first direction, and the first firing means fires a second drop of the first fluid at the first velocity while the print head is moving in the second direction to form a fourth dot on the medium; and means for relatively adjusting the firing between the first and second drops of the first fluid by at least one stroke such that a distance between the first dot and the fourth dot is less than or equal to a predetermined amount.

* * * * *